US009027769B2

(12) United States Patent
Willows et al.

(10) Patent No.: US 9,027,769 B2
(45) Date of Patent: May 12, 2015

(54) CAP WITH INTEGRATED SPOUT

(75) Inventors: Keith S. Willows, Seattle, WA (US); June A. Angus, Seattle, WA (US); Antonio Del Rosario, Bellevue, WA (US)

(73) Assignee: Amphipod, Inc., Seattle, WA (US)

( * ) Notice: Subject to any disclaimer, the term of this patent is extended or adjusted under 35 U.S.C. 154(b) by 379 days.

(21) Appl. No.: 12/956,798

(22) Filed: Nov. 30, 2010

(65) Prior Publication Data

US 2011/0127232 A1 Jun. 2, 2011

Related U.S. Application Data

(60) Provisional application No. 61/283,364, filed on Dec. 2, 2009.

(51) Int. Cl.

| | |
|---|---|
| ***B65D 39/08*** | (2006.01) |
| ***B65D 41/34*** | (2006.01) |
| ***B65D 47/08*** | (2006.01) |
| ***B65D 47/14*** | (2006.01) |
| *A47G 19/22* | (2006.01) |

(52) U.S. Cl.

CPC ..... *B65D 47/088* (2013.01); *B65D 47/142* (2013.01); *B65D 47/143* (2013.01)

(58) Field of Classification Search

USPC ..... 215/254, 306, 387, 320, 321, 343, 329; 220/703, 711, 714, 789, 716, 717, 220/256.1

See application file for complete search history.

(56) References Cited

U.S. PATENT DOCUMENTS

| | | | | |
|---|---|---|---|---|
| 4,066,191 | A * | 1/1978 | Coleman | 222/569 |
| 4,456,140 | A * | 6/1984 | Geiger | 215/364 |
| 5,361,921 | A * | 11/1994 | Burns | 215/320 |
| 5,893,472 | A * | 4/1999 | Forrer | 215/11.4 |
| 6,112,951 | A * | 9/2000 | Mueller | 222/490 |
| 6,644,487 | B2 * | 11/2003 | Smith et al. | 215/235 |
| 6,991,126 | B2 * | 1/2006 | Jackel | 220/259.1 |
| 7,546,919 | B2 * | 6/2009 | Lee | 206/221 |
| 7,611,025 | B2 * | 11/2009 | Nusbaum et al. | 215/253 |
| 7,658,295 | B2 * | 2/2010 | Hoepner et al. | 215/237 |
| 7,721,901 | B1 * | 5/2010 | Von Spreckelsen et al. | 215/232 |
| 8,448,797 | B2 * | 5/2013 | Cho | 215/228 |
| 2008/0041809 | A1 * | 2/2008 | Shek | 215/315 |
| 2009/0236341 | A1 * | 9/2009 | Mckinney et al. | 220/375 |

FOREIGN PATENT DOCUMENTS

JP 2004106888 A * 4/2004

* cited by examiner

*Primary Examiner* — Mickey Yu
*Assistant Examiner* — Niki Eloshway
(74) *Attorney, Agent, or Firm* — Lowe Graham Jones PLLC

(57) ABSTRACT

A cap having an integrated spout includes an overcap with an insert for providing a seal for the spout. In various versions, the spout or insert include ribs or other features to provide a watertight seal between the spout and insert. The spout is preferably formed from a resilient material.

13 Claims, 18 Drawing Sheets

CAP WITH INTEGRATED SPOUT

This application claims the benefit of prior U.S. provisional application Ser. No. 61/283,364, filed Dec. 2, 2009.

FIELD OF THE INVENTION

The present invention relates to a cap with an integrated spout which attaches to a container preferably for carrying fluid, although it could be used for carrying powder or some other material that a user may want to pour or dispense.

BACKGROUND OF THE INVENTION

There are a variety of caps with and without integrated spouts for drinking or pouring liquids or the like from containers. There are fewer options for use in sporting applications where the user is running, exercising or participating in a sport in which quick and simple access to fluids is desired. There are even fewer cap/spout options available for using with non-squeeze type rigid bottles. The available caps/spouts for use with rigid type bottles such as those made from stainless steel, other metals like titanium, hard plastics like tritan (a bpa-free plastic similar to polycarbonate or the like) are generally poor for use in active sport applications. Some of the drawbacks of existing caps/spouts include problems with hitting the teeth or lips while drinking; the requirement to suck from the bottle, which can be difficult when exercising; the difficulties in cleaning, resulting in unhygienic conditions; general difficulty in getting fluid through the cap/spout; inability to control the flow, which can result in the user spilling or swallowing air; and other uncomfortable, inefficient and inconvenient drawbacks.

The available spouts/caps heretofore known suffer from additional drawbacks and disadvantages in combinations in the following areas:

They have the tendency to leak and have unreliable seals.

They have seals that are difficult to clean and wear out easily.

They have multiple parts with hard to clean areas/crevices that can lead to unhygienic conditions.

Many require vents which have been known to clog, leak, and are hard to clean.

They have small parts that can fall off and are lost easily.

They have unreliable and often very slow and uneven liquid flow.

Require both hands to remove/open cap to access fluid.

They easily freeze up in cold conditions.

They employ features which present obstacles to optimal athletic or general performance.

They have limited versatility for range of uses and range of users.

They are generally difficult and/or inconvenient to use.

SUMMARY OF THE INVENTION

The present invention comprises a new and novel cap with integrated spout. A preferred version of the invention has a main cap body/spout retainer for retaining the spout or the like, a spout for directing the flow of fluid or the like, an overcap for capping the spout, and preferably a tether for retaining the overcap and the main/cap retainer.

The preferred cap as described below can be produced in a manner that, in various examples of the invention, has superior leak resistance, usability, cleanability, and durability among many other positive attributes.

The invention includes a number of desirable optional features which can be used with in combination with the spout/cap and associated container or the like, or alone. Combinations of the disclosed embodiments and materials can be made with varying advantages, depending on the needs of the user.

Some of the advantages of various versions of the present invention include:

The cap can be configured to work with a variety of containers, materials and styles.

The cap can be manufactured from inert and hygienic materials.

The cap is easily and simply cleanable.

The cap can be sterilized easily without degrading the materials.

The cap can be made such that it is soft on the mouth.

The cap provides a malleable spout that the user can use to easily control the flow of fluid.

The cap does not require the user to suck to drink.

Fluids can be quickly, simply and seamlessly accessed.

The cap includes a highly leak-proof and reliable system.

Seal areas are easily accessible and can be easily cleaned.

The spout can be easily and simply replaced if desired.

The cap can be used such that the user does not swallow air while drinking.

The cap can be configured such that it flows in a steady and controllable stream.

The cap allows the user to control the fluid flow.

The cap allows simple one handed or bite/teeth access.

The cap does not freeze up easily in cold conditions.

The system can be fabricated in a manner that is lightweight and durable.

The cap can be manufactured simply and inexpensively, using a minimum of material/parts.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
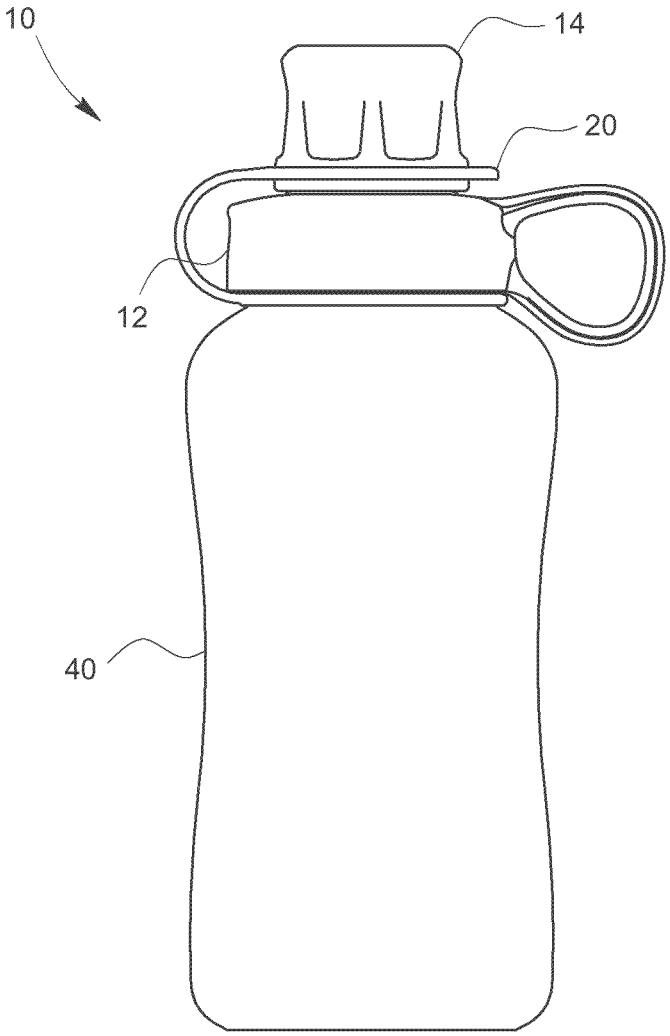
FIG. 1 is a side view of a preferred container with spout.

FIG. 1 shows the preferred embodiment of the invention assembled to a bottle 40. In this case, reference number 10 points to a combined bottle with cap and other components. The preferable overcap 14 is shown tightened down to the cap body 12 such that it is in a stowed or closed position and fully secured or sealed for transport.

Figure 2:
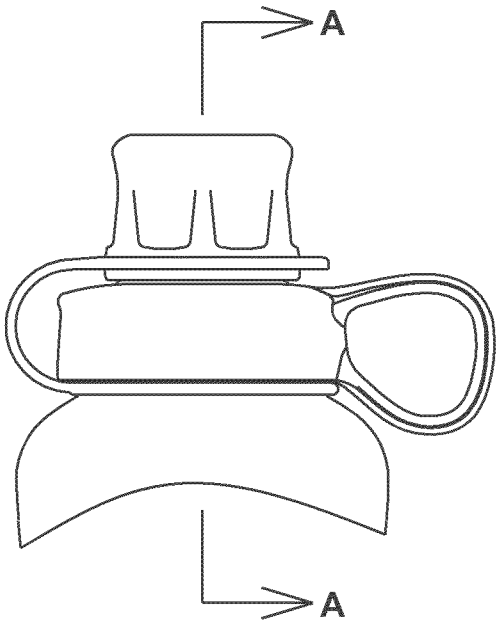
FIG. 2 is a perspective view of the spout and upper portion of the container of FIG. 1.

FIG. 2 shows the bottle and overcap assembled to a bottle as with FIG. 1, but with the bottle cut away for drawing simplicity. It should be appreciated that any bottle size and shape is possible for use with the caps and spouts as described below, and therefore most of the description that follows will be made with respect to a partial cutaway bottle as depicted in FIG. 2. This view shows the cap assembly secured to the bottle as with FIG. 1.

Figure 3:
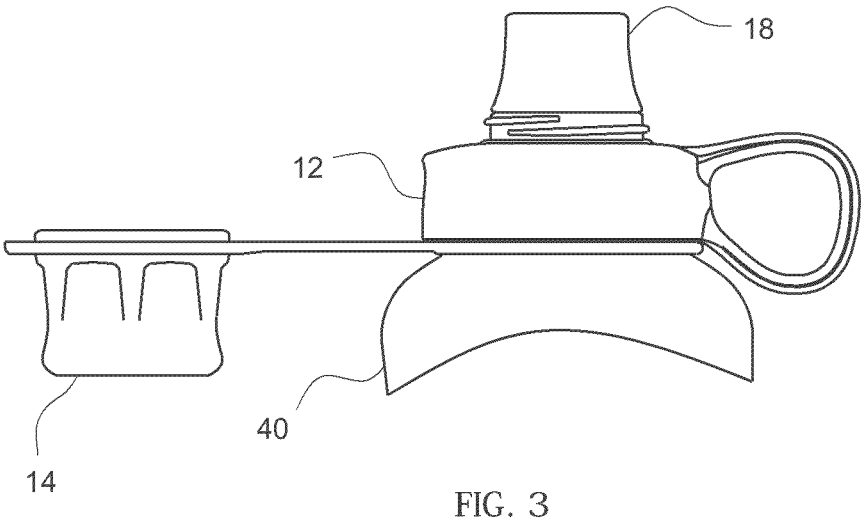
FIG. 3 is a partial view of the spout of FIG. 1, shown with a cap removed.

FIG. 3 shows a preferable embodiment of a cap attached to a bottle 40 which is cut away for drawing simplicity. The spout overcap 14 is disengaged from the spout 18 and the main cap body 12 such that the spout is accessible for drinking/pouring or otherwise providing ready access to the contained fluid or other stuff held in the container.

Figure 4:
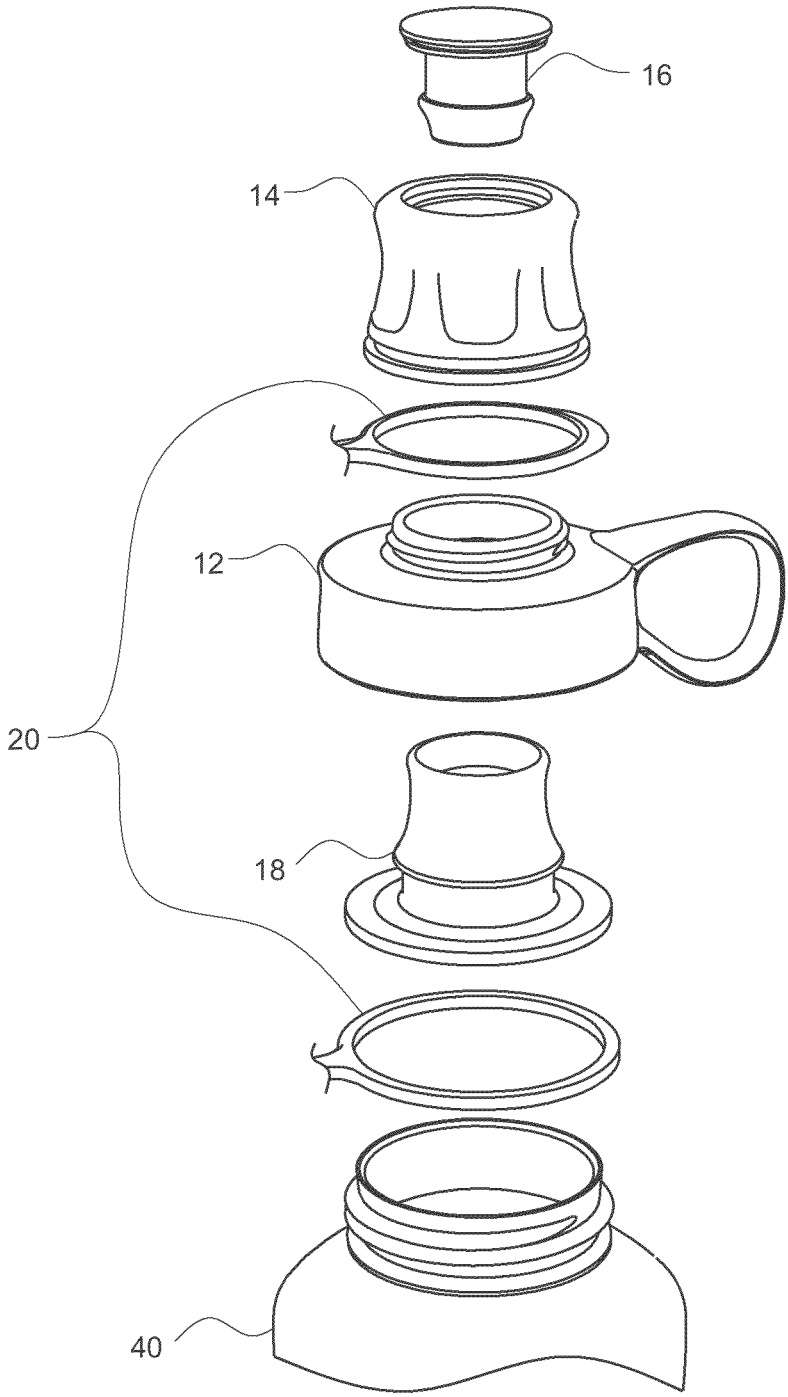
FIG. 4 is an exploded view of the spout and cap, shown together with an upper portion of a bottle.

FIG. 4 shows an exploded view of a preferred version of the invention in which a tether 20 and part of the bottle 40 are both cut away for drawing simplicity. An exemplary tether is further illustrated in FIGS. 26 and 27 and described below. FIG. 4 shows how the preferred insert 16 can be preferably pressed and snapped into the spout from the top (or in some versions from the bottom) and the spout 18 can preferably be pressed into the cap body 12 by forcing it in from the bottom.

Figure 5:
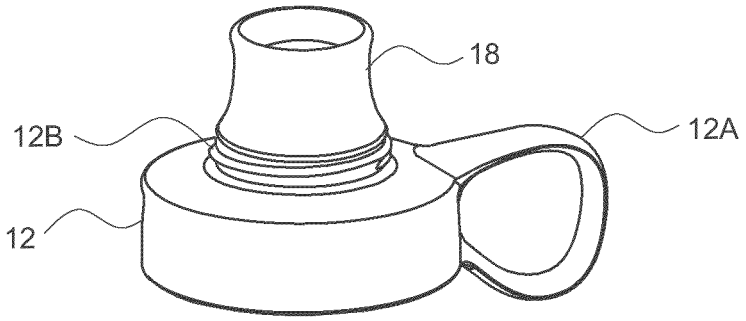
FIG. 5 is a perspective view of a main cap body and spout.

FIG. 5 shows a spout 18 assembled in place in a cap body 12. The same assembly is further shown in cross-section in FIG. 9 and additional views as described below. FIG. 5 shows the preferable main cap body 12 with a preferred spout 18 assembled together and seated within the main cap body. Also visible within FIG. 5 are a set of upper male threads 12B formed along an upper neck of the main cap body. A ring 12A is further secured to the main cap body. As shown, the ring is integrally formed with the main cap body and sized to receive at least one finger of a user.

Figure 6:
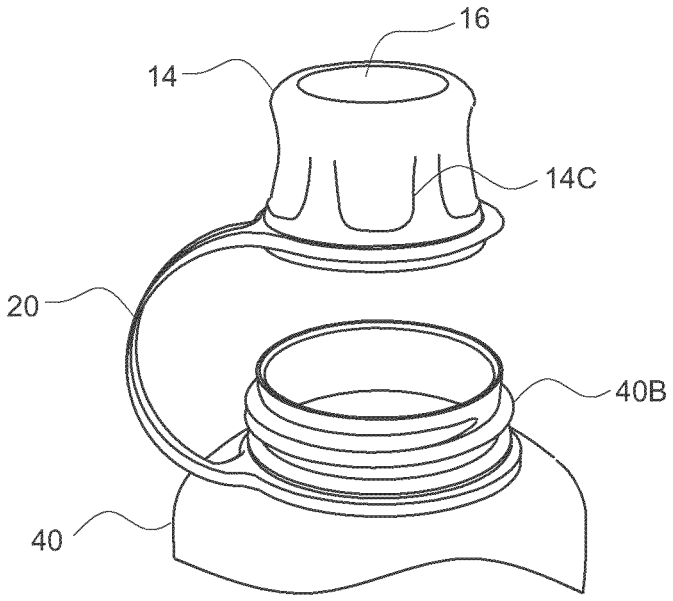
FIG. 6 is a perspective view of a spout overcap and insert, shown atop a partial view of a bottle.

FIG. 6 shows the preferable spout overcap 14 assembled with a tether 20 and preferable overcap insert 16. The overcap insert is trapped within an upper portion of the overcap 14, and in the view of FIG. 6 only one end of the insert 16 is visible. The tether 20 further is shown assembled with bottle 40. As described more fully below, the tether is formed with opposing rings separated by a band, with one of the rings receiving the overcap and the other ring receiving the neck of the bottle. The neck of the bottle includes threads 40B, preferably on an outer surface of the neck in order to receive mating female threads formed inside the cap body 12. As shown, the overcap 14 includes multiple finger grips 14C, preferably formed as undulations that are scooped out or otherwise textured or formed about the outer surface of the overcap to improve the grip.

Figure 7:
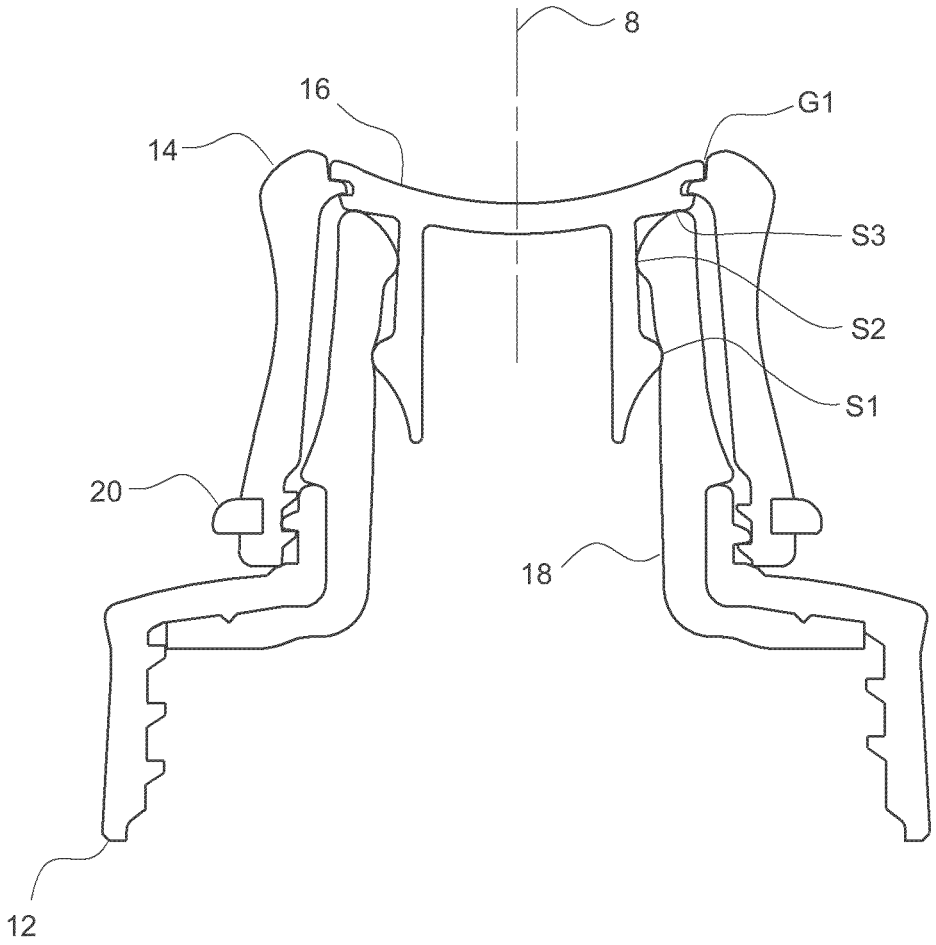
FIG. 7 is a sectional view of a spout and partial container, taken along lines A-A in FIG. 2.

FIG. 7 shows a sectional view of the preferred embodiment as described above, taken along lines A-A in FIG. 2. The overcap 14 is shown screwed down closed, such that sealing ring contact areas S1, S2, and S3 (providing sealing between spout 18 and insert 16) are in contact to very reliably seal the spout. Axis line 8 and sliding interface G1 between insert 16 and overcap portion 14 are also labeled. Only the section portion of the smaller ring of the tether is shown for drawing simplicity and the bottle is not shown for drawing simplicity as well.

As shown in FIG. 7, the insert 16 includes an upper portion that is substantially circular about its perimeter and includes a circumferential channel. The version as shown further includes a concavity along the upper portion to provide a recessed area for better engaging a thumb or finger of a user. The circumferential channel is sized and positioned to receive a mating flange formed along the upper edge of the overcap 14, thereby trapping the insert 16 within the overcap 14. In other versions the overcap and insert may be integrally formed.

The insert further includes a substantially cylindrical stem extending downward from the upper portion of the insert. The stem terminates in a tapered edge, providing increased flexibility and allowing the insert to more readily be received within the spout 18. The insert further flares outwardly along an intermediate portion to form an insert rib that provides the snug interface at contact area S1.

Figure 8:
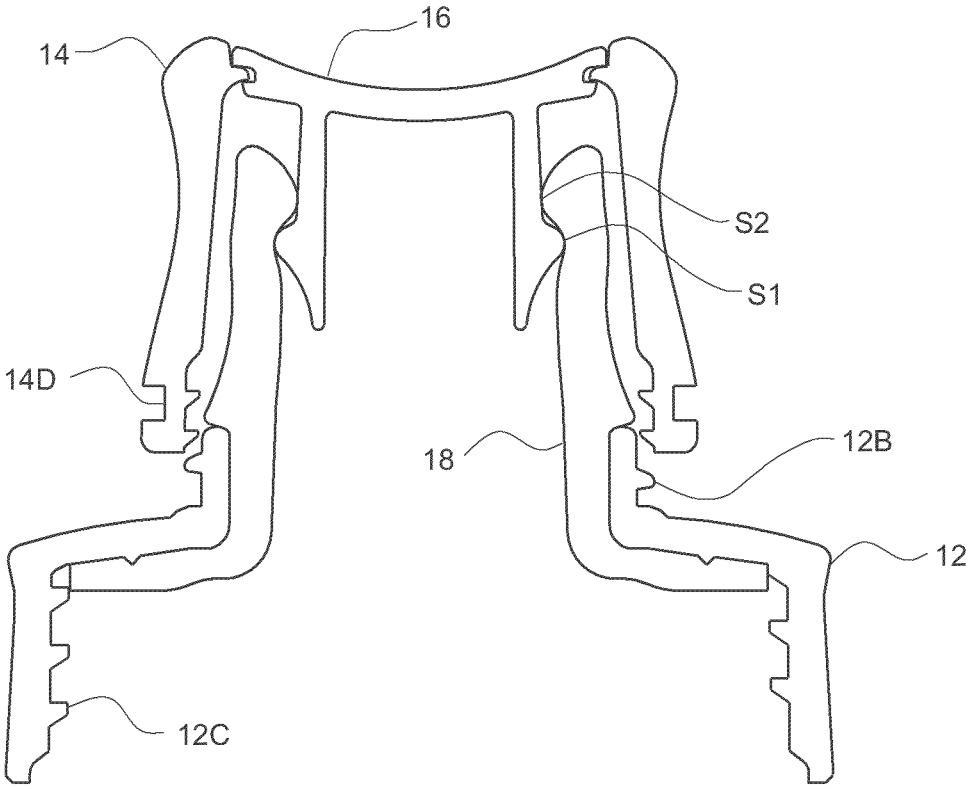
FIG. 8 is a sectional view of the same components as with FIG. 7, but with the overcap unscrewed and raised upward.

FIG. 8 shows a sectional view of the preferred embodiment taken along lines A-A in FIG. 2 but with overcap 14 unscrewed and still held captive in spout 18. This view shows a ready-access position wherein a user can pop of the top (by directly pulling on the overcap portion, by flipping the overcap off with a thumb, pulling overcap off with teeth, etc.) for quick access to fluids but the spout is still fully sealed in this position such that if the container is knocked over or turned sideways or upside-down it is spill-safe. The preferable tether is not shown in FIG. 8 such that tether retention grove 14D is more readily visible. The main cap body 12 includes internal threads 12C.

Figure 9:
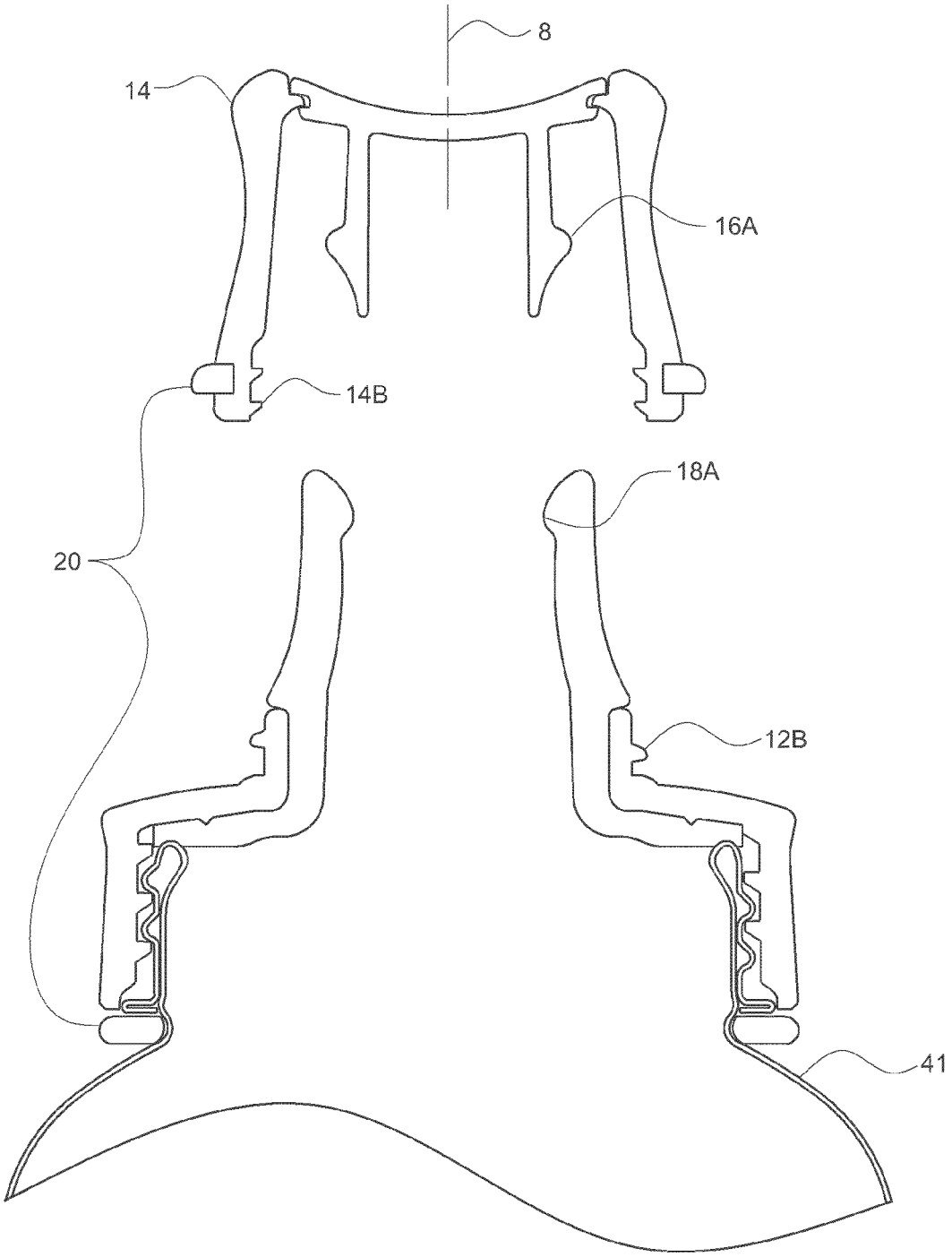
FIG. 9 is a sectional view of the same components as with FIG. 7, but with the overcap removed to form a partially exploded sectional view.

FIG. 9 shows a sectional, partially exploded view of the preferred embodiment taken along lines A-A in FIG. 2 but with overcap 14 unscrewed and fully removed from the spout. The bottle 41 having an exemplary threaded neck is shown in cross-section in a partial cut-away view and further shown screwed into the preferable main cap body. Preferable seal rib 16A on the insert and preferable seal rib 18A on the spout are also labeled and visible in this sectional view. The seal rib 18A on the spout is formed as an annular rib projecting radially inward about the inside walls of the spout. As illustrated, it is positioned close to the upper end of the spout and sized such that it will snugly receive the outer walls of the insert 16. In this view it can be seen how the insert 16 can be snapped into the spout 18 by pressing down on the overcap to force the stem of the insert into the mouth formed by the spout so that the overcap can be removably retained by the interlocking of features of the spout rib 18A and insert rib 16A (see also FIG. 10 which shows these features in an interlocking position).

Figure 10:
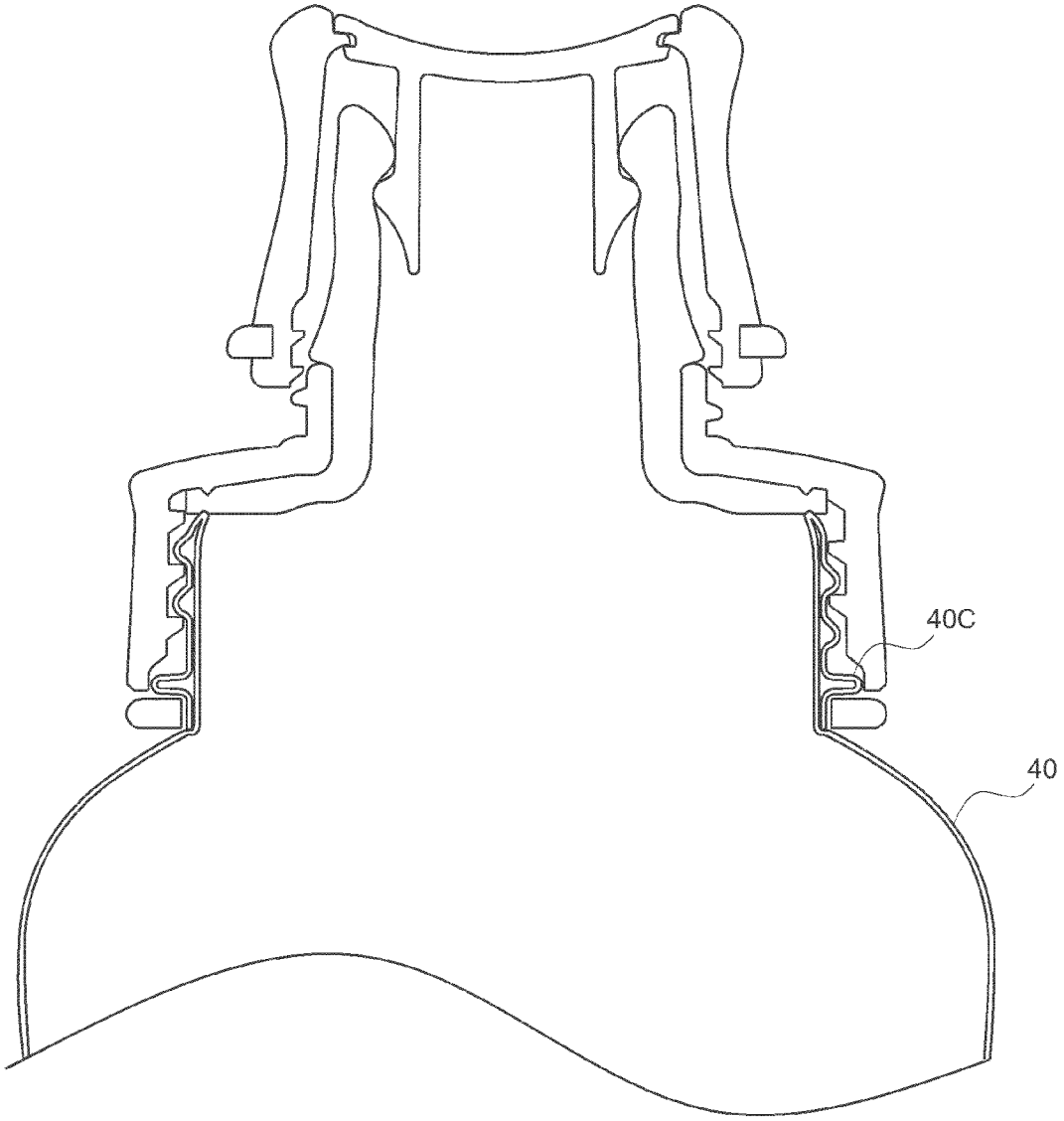
FIG. 10 is a sectional view of the same components as with FIG. 7, but with the overcap unscrewed and raised upward.

FIG. 10 shows a sectional view of the preferred embodiment taken along lines A-A in FIG. 2. In this case, the overcap is unscrewed but still held captive in a spout such that the overcap is held in place and the spout is sealed with ready access being provided to the spout by the user simply popping/pulling off the overcap. In this view, the tether retaining ring feature 40C is also included. As shown, the spout rib and insert rib are sized to snugly receive the insert and spout sidewalls, respectively, to form a substantially watertight seal.

Figure 11:
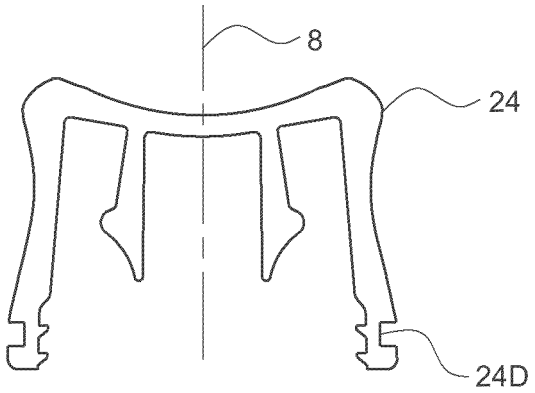
FIG. 11 is a sectional view of an overcap, taken along the same plane as with lines A-A in FIG. 2.

FIG. 11 shows a sectional view of an alternate embodiment taken along lines A-A in FIG. 2 but illustrating only an overcap 24 (with tether ring portion removed so that recessed tether ring grove 24D is visible). In this version, the overcap and insert are integrally formed as one piece. Although the spout overcap and insert can be integrated in one piece, it is preferable to form them as separate components that are later joined together. Regardless of whether they are integrally formed or joined as separate components, the upper plate and downward stem are referred to as an "insert" in either case. In the preferred version, the overcap 24 is preferably generally axially symmetrical about a central axis 8 (with some exceptions such as threads, external finger grip features, in-molded logos or other in-molded aesthetic or functional features).

Figure 12:
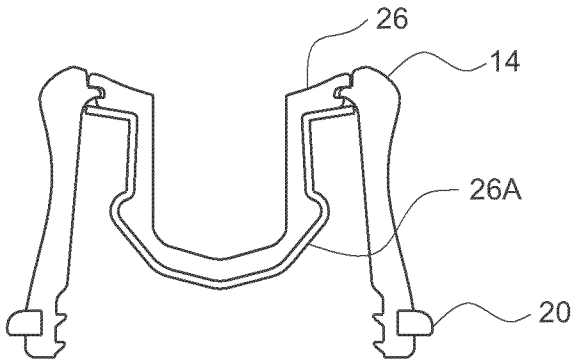
FIG. 12 is a sectional view of an alternate overcap, taken along the same plane as with lines A-A in FIG. 2.

FIG. 12 shows a sectional view of another alternate version of an overcap 14 taken along lines A-A as in FIG. 2 but in this case only illustrating the overcap 14 (with tether ring portion labeled 20). In this case, the insert 26 includes a stainless steel or the like cover portion 26A. The insert and cover portion are formed with an end cap rather than an opening as with the prior versions.

Figure 13:
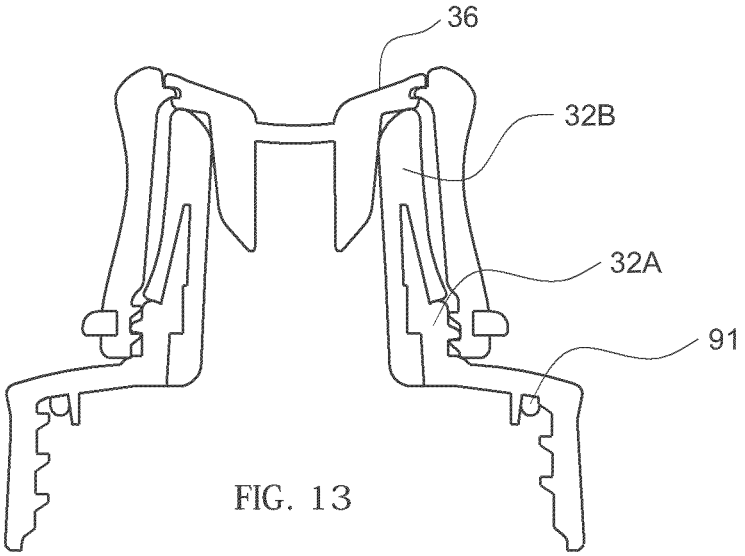
FIG. 13 is a sectional view of an upper end of a bottle and preferred cap, taken along the same plane as with lines A-A in FIG. 2.

FIG. 13 shows a sectional view of another version taken along lines A-A in FIG. 2, in this case showing the overcap (with tether ring portion) and another example of an optional insert 36. In this version, the spout and insert do not include ribs as described with respect to the prior versions, and instead the insert and spout are formed with complementary inside and outside diameters such that the insert is snugly received within the spout. Also shown is how the main cap body portion 32A can be co-molded/insert molded or otherwise assembled as shown with integrate spout portion 32B and O-ring or the like portion 91 (which could also be assembled separately or at the same time as the spout portion 32B, co-molded, inserted or the like). Only the smaller ring of the tether is shown for drawing simplicity and bottle is not shown for drawing simplicity as well.

Figure 14:
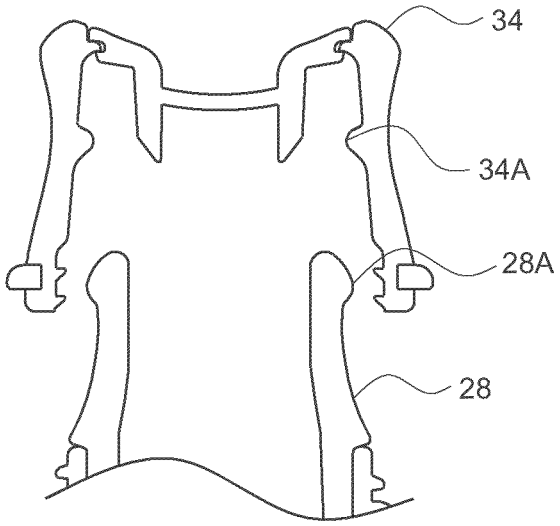
FIG. 14 is a sectional view of an alternate insert and overcap, taken along the same plane as with lines A-A in FIG. 2.

FIG. 14 shows a sectional view of another and in most cases less preferred embodiment taken along lines A-A in FIG. 2 showing overcap embodiment 34 (with tether ring portion) and another embodiment of an optional insert. Also shown is ring ridge retainer portion 34A of overcap 34 which is configured to mate with ring lip portion 28A of spout 28. In this case, the ring ridge retainer portion 34A is an annular ring projecting inward from the overcap 34 in order to contact an outside wall of the spout, while the ring lip portion 28A of the spout is configured to contact an inside wall of the overcap in order to provide a seal or to retain the overcap on the spout. Only the smaller ring of the tether is shown for drawing simplicity, a portion of the spout 28 and cap body, also bottle is not shown for drawing simplicity as well. The portion of spout embodiment 28 shown is less desirable in most cases from the preferred embodiment, the remaining portion would preferably be configured similar to preferable spout 18 that can be best seen in FIG. 4.

Figure 15:
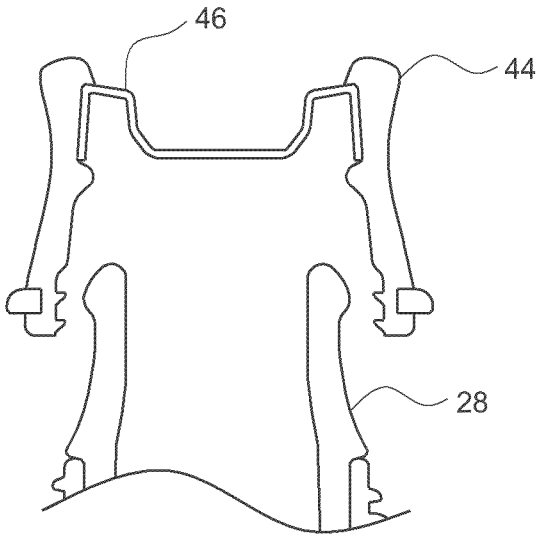
FIG. 15 is a sectional view of an alternate insert and overcap, taken along the same plane as with lines A-A in FIG. 2.

FIG. 15 shows a sectional view of another embodiment taken along lines A-A in FIG. 2 showing overcap embodiment 44 (with tether ring portion) and another embodiment of an optional insert 46 which is preferably stamped or otherwise formed from stainless steel or some other thin metal (preferably 0.005 to 0.030 inches thick depending on desired properties but it most cases is preferably about 0.01 inches thick) or the like and preferably press-inserted into 44 where it resides and is preferably captive (the fit is preferably configured such that it does not freely spin although in some cases a fit such that it freely spins may be desirable). Only the smaller ring of the tether is shown for drawing simplicity. A portion of the spout 28 and cap body and the bottle are not shown for drawing simplicity as well.

Figure 16:
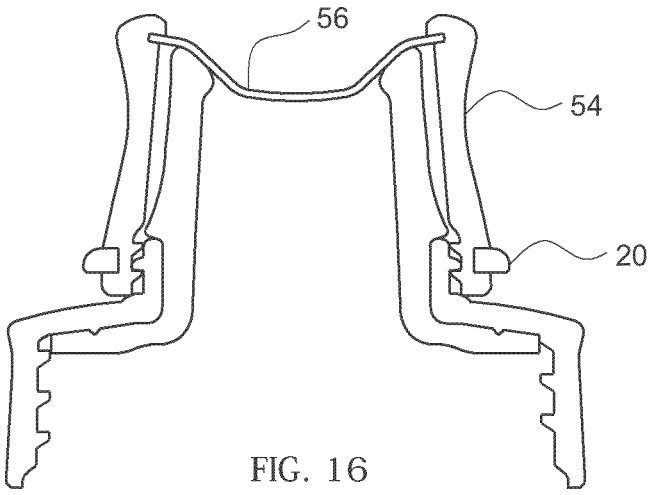
FIG. 16 is a sectional view of an alternate upper end of a bottle and spout, taken along the same plane as with lines A-A in FIG. 2.

FIG. 16 shows a sectional view of another embodiment taken along lines A-A in FIG. 2 and showing overcap 54 (with tether ring portion 20 labeled) and another embodiment of an optional insert 56 which is preferably stamped or otherwise formed from stainless steel or some other thin metal or the like (preferably 0.005 to 0.030 inches thick depending on desired properties but it most cases is preferably about 0.01 inches thick) or the like and preferably press-inserted (or insert molded or otherwise assembled together) with an overcap 54 where it resides and is preferably captive (the fit is preferably configured such that it does not freely spin although in some cases a fit such that it freely spins may be desirable). Thus, in this case the insert 56 is primarily in the form of a disk that is stamped to form a concavity that extends downward toward the spout when positioned within the overcap. Only the smaller ring of the tether is shown for drawing simplicity and bottle is not shown for drawing simplicity as well.

Figure 17:
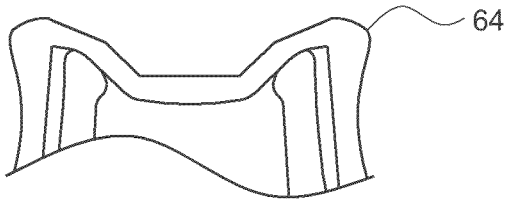
FIG. 17 is a sectional view of an alternate overcap, taken along the same plane as with lines A-A in FIG. 2.

FIG. 17 shows a cutaway sectional view of another preferred embodiment taken along lines A-A in FIG. 2 showing overcap 64 molded as a simple cap without a separately formed insert. Much of the rest of the cap is cut away for drawing simplicity. In this case, the insert and overcap are generally in the same shape as with FIG. 16, though formed as an integral component rather than two pieces joined together.

Figure 18:
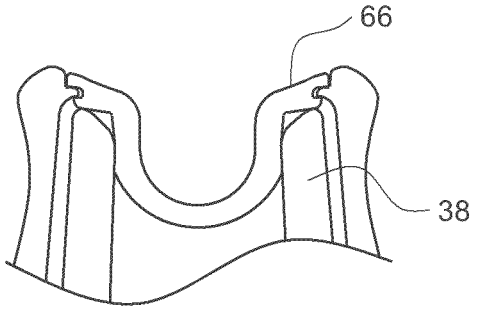
FIG. 18 is a sectional view of an alternate overcap, taken along the same plane as with lines A-A in FIG. 2.

FIG. 18 shows a sectional view of another preferred embodiment taken along lines A-A in FIG. 2 showing insert 66 and spout 38. Much of the rest of the cap is cut away for drawing simplicity. In this case the insert is formed with a more rounded lower end, having a deeper concavity than the version illustrated in FIG. 16.

Figure 19:
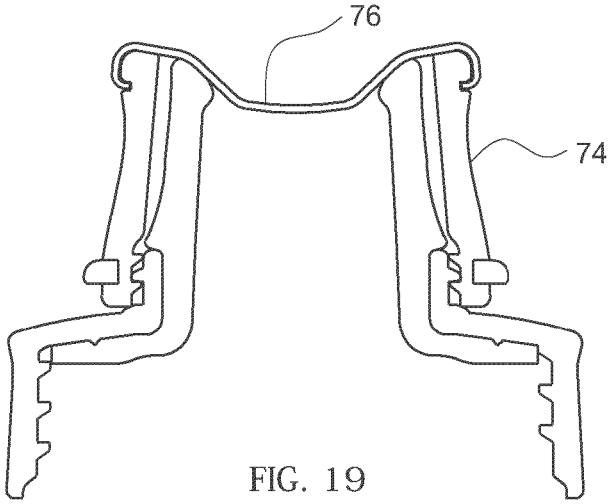
FIG. 19 is a sectional view of an alternate cap and upper end of a bottle, taken along the same plane as with lines A-A in FIG. 2.

FIG. 19 shows a sectional view of another preferred embodiment taken along lines A-A in FIG. 2. As with several of the sectional views described above and which follow, FIG. 19 does not match up with the actual version of FIG. 2, but rather shows an end cap that is in sectional view along the same cut plane indicated by lines A-A in FIG. 2. In this version, the overcap 74 (with tether ring portion shown) includes an insert 76 which is preferably stamped or otherwise formed from stainless steel or some other thin metal (preferably 0.005 to 0.030 inches thick depending on desired properties but it most cases is preferably about 0.01 inches thick) or the like and preferably press-inserted onto the end-cap 74 where it resides and is preferably captive (the fit is preferably configured such that it does not freely spin although in some cases a fit such that it is spins may be desirable). Only the smaller ring of the tether is shown for drawing simplicity, also bottle is not shown for drawing simplicity as well. Though still using the term "insert" for the upper and interior portion of the end cap, in this case the insert 76 actually extends outwardly around an outside portion of the end cap 74. An interior portion of the insert 76 is formed with a concavity in this version, with the concavity extending downwardly into a portion of the end cap.

Figure 20:
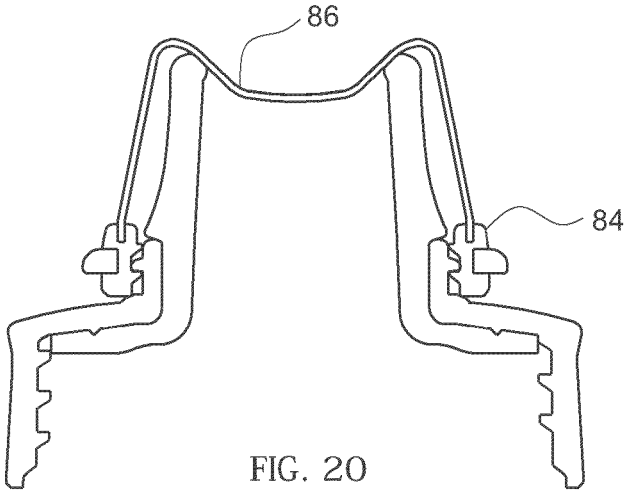
FIG. 20 is a sectional view of an alternate cap and upper end of a bottle, taken along the same plane as with lines A-A in FIG. 2.

FIG. 20 shows a sectional view of another preferred embodiment taken along lines A-A in FIG. 2 (for reference of section, but the view in FIG. 2 would show the appropriate changed geometry/features of the overcap assembly specific to this embodiment) showing overcap portion embodiment 84, thread ring (with tether ring portion) and another embodiment of an optional insert/integrated overcap 86 which is preferably stamped or otherwise formed from stainless steel or some other thin metal (preferably 0.005 to 0.030 inches thick depending on desired properties but it most cases is preferably about 0.01 inches thick) or the like and preferably insert molded (or press-inserted or otherwise assembled) to 84 where it resides and is preferably captive (the fit is preferably configured such that it does not freely spin with respect to threaded ring portion 84). Only the smaller ring of the tether is shown for drawing simplicity, also bottle is not shown for drawing simplicity as well. In this version, the insert 86 substantially surrounds the end cap, though it is still referred to as an insert.

Figure 21:
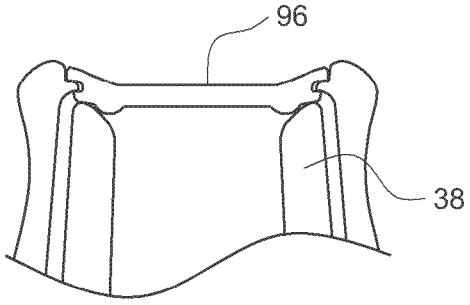
FIG. 21 is a sectional view of an alternate inset and spout, taken along the same plane as with lines A-A in FIG. 2.

FIG. 21 shows a sectional view of another preferred embodiment taken along lines A-A in FIG. 2 showing flat insert 96 and a cutaway portion of a spout 38 (the fit is preferably configured such that 96 freely spins although in some cases a fit such that it is fixed may be desirable). Insert 96 can be snap inserted in place or alternately can be insert molded, integrally molded or the like with overcap portion.

Figure 22:
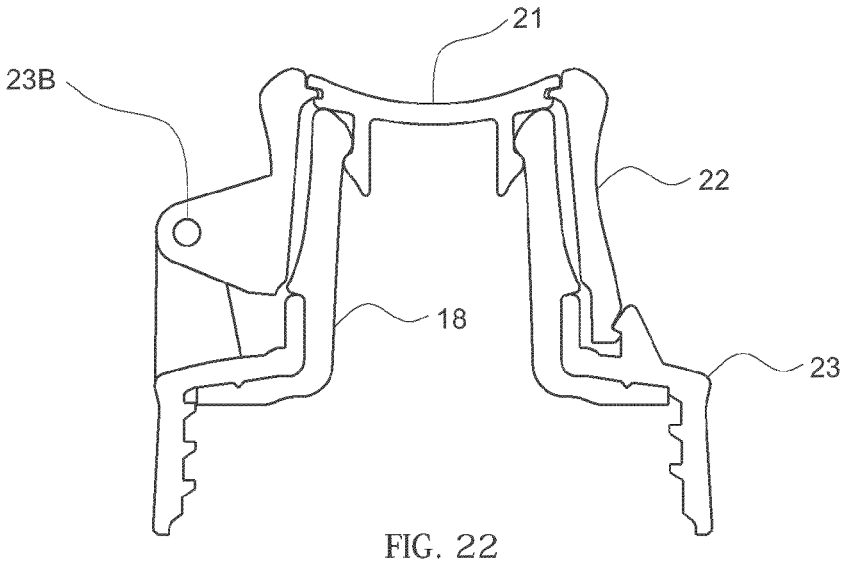
FIG. 22 is a sectional view of an alternate cap and upper end of a bottle, taken along the same plane as with lines A-A in FIG. 2.

FIG. 22 shows a sectional view of a another preferred embodiment taken along lines A-A in FIG. 2 (again, noting that the reference to FIG. 2 is an indication of the context of the sectional view rather than an indication that the identical version as shown in FIG. 2 is also illustrated in FIG. 22). Insert 21, spout 18, overcap 22 and cap body 23 embodiments are labeled. Overcap 22 and cap body 23 are attached at preferably integrated pivot hinge 23B wherein overcap assembly (21 and 22) can rotate about pivot hinge 23B whereby the overcap assembly is openable to allow access to drinking spout 18. As shown, the pivot hinge is provided at an intersection of a vertical post formed on the cap body 23 and a lateral arm formed on the overcap 22. Insert 21 is preferably assembled with 22 by snapping them together (such that preferably air/gas can escape out through this connection) but in some cases it may be desirable to insert-mold 21 and 22 together, integrally mold them as one part, or otherwise assemble them together.

Figure 23:
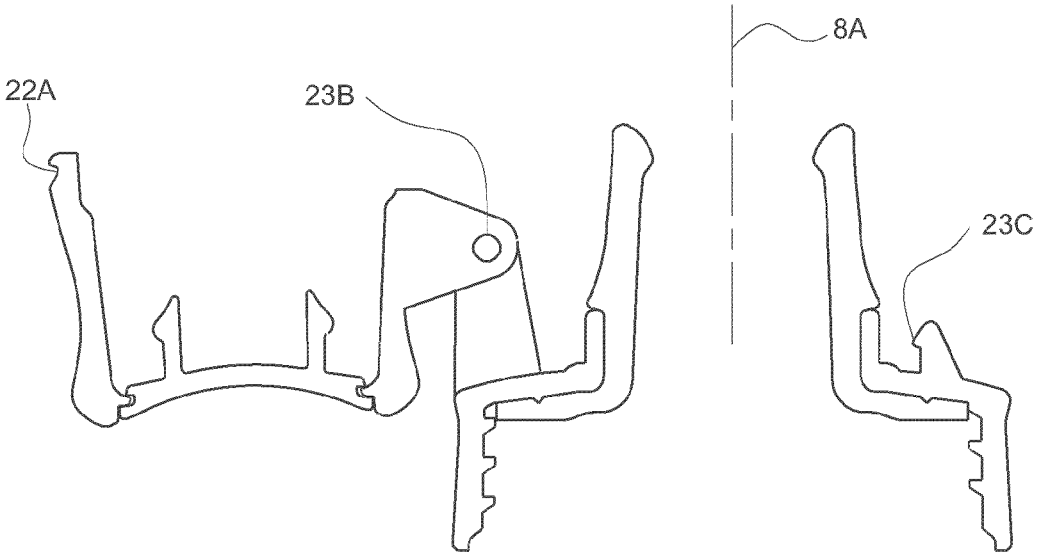
FIG. 23 is a sectional view of an alternate cap and upper end of a bottle, taken along the same plane as with lines A-A in FIG. 2.

FIG. 23 shows a sectional view of the embodiment shown in FIG. 22 with the overcap assembly (21 and 22) disengaged and rotated away from local snap feature (23C on cap body 23) such that access to the spout is provided for drinking. Local snap feature 23C preferably mates with local recess feature 22A on 22 such that the overcap is held retained. The embodiment shown in FIG. 22 and FIG. 23 is less preferable than the preferred embodiment.

Figure 24:
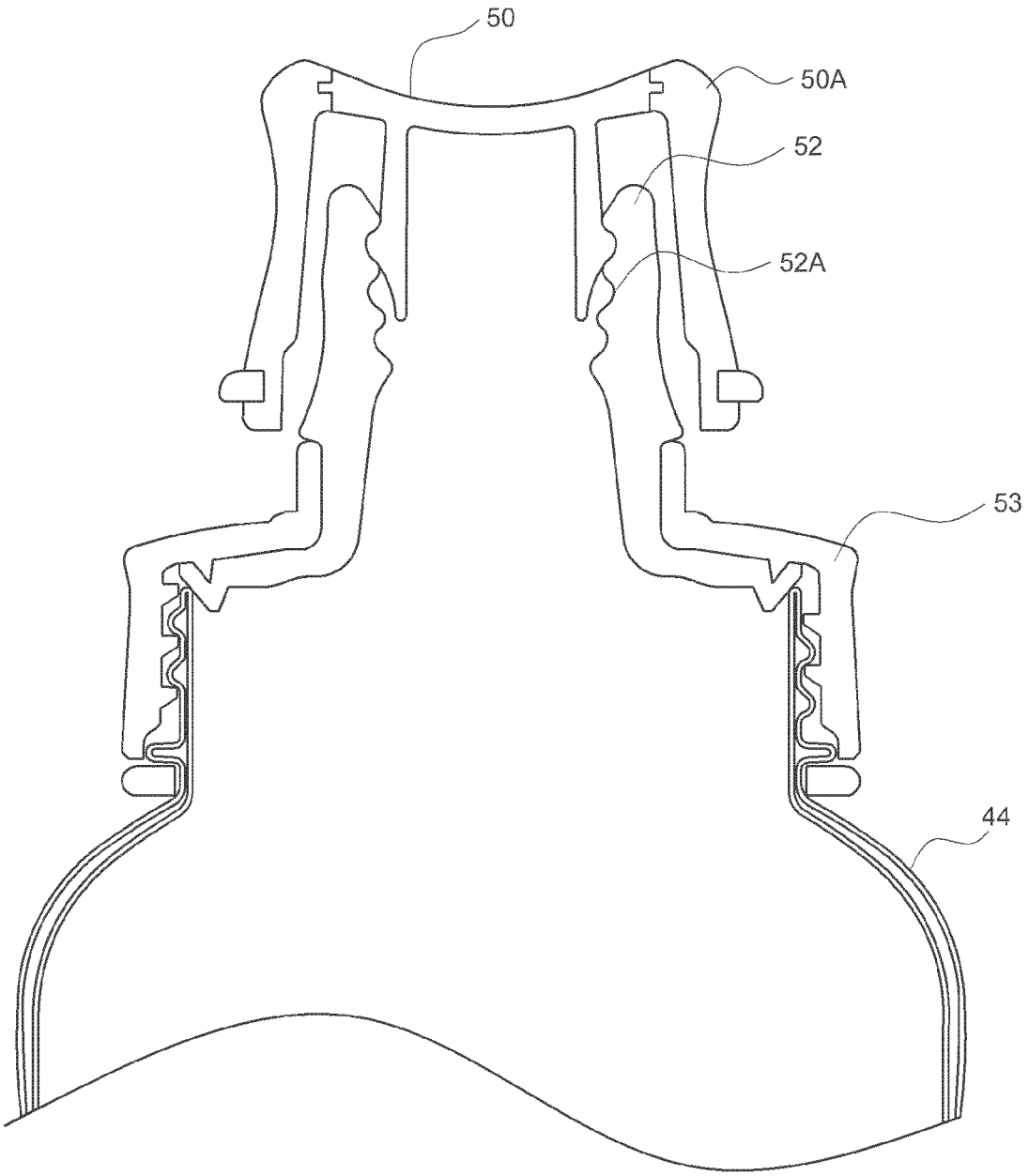
FIG. 24 is a sectional view of an alternate cap and upper end of a bottle, taken along the same plane as with lines A-A in FIG. 2.

FIG. 24 shows a sectional view of another preferred embodiment taken along lines A-A in FIG. 2 (with overcap slightly moved up and away from the cap body) showing insert portion 50 (which is shown preferably insert molded in overcap portion 50A in this less preferable embodiment). Also spout 52 is shown with multiple internally ribbed seating areas 52A for mating with the insert, each seating area preferably has a diameter that gets progressively smaller moving down into the spout such that the seal gets progressively tighter the farther the insert is pressed into the spout 52. Although it is not preferable it can also be seen how ribbing 52A could be exchanged for coarse screw threads molded internally into spout 52 with a mating thread or threads molded into insert 50 such that the overcap is screwed down closed. Bottle 44 is shown with a double wall which in some cases is desirable for insulating the bottle contents. Only a portion of the bottle 44 is shown for drawing simplicity.

Figure 25:
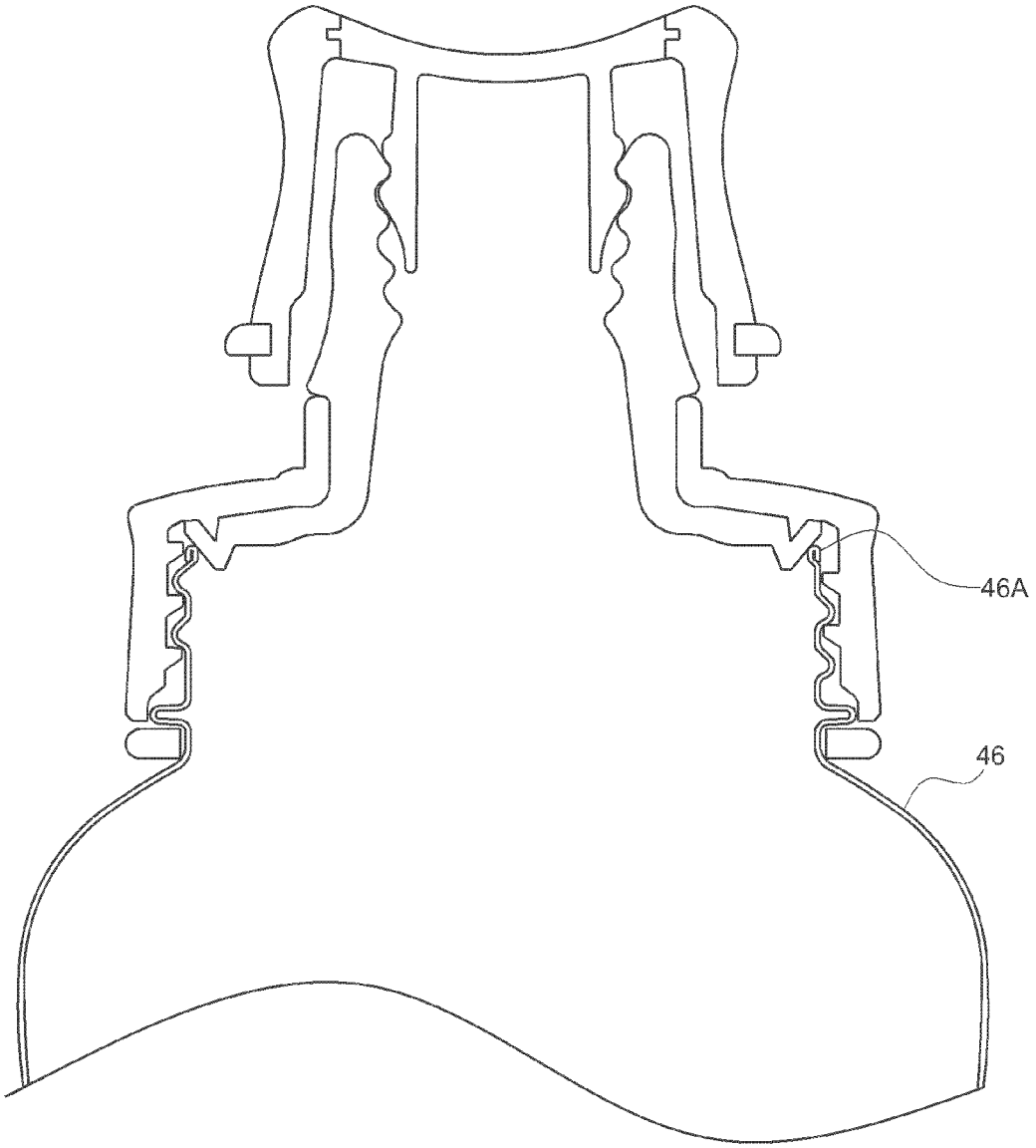
FIG. 25 is a sectional view of an alternate cap and upper end of a bottle, taken along the same plane as with lines A-A in FIG. 2.

FIG. 25 shows a sectional view of another preferred embodiment taken along lines A-A in FIG. 2 (with overcap slightly moved up and away from the cap body) showing a double-ribbed insert (which could be replaced with a thread and mating thread on the spout as well). Only a portion of the bottle 46 is shown for drawing simplicity. Bottle 46 shows a less preferable bottle embodiment with the exposed internal backside of the external threads. Bottle 46 is shown with a single wall and also shows how the mouth portion 46A of bottle 46 can be finished such that the edge is turn over so that it is finished and not sharp.

Figure 26:
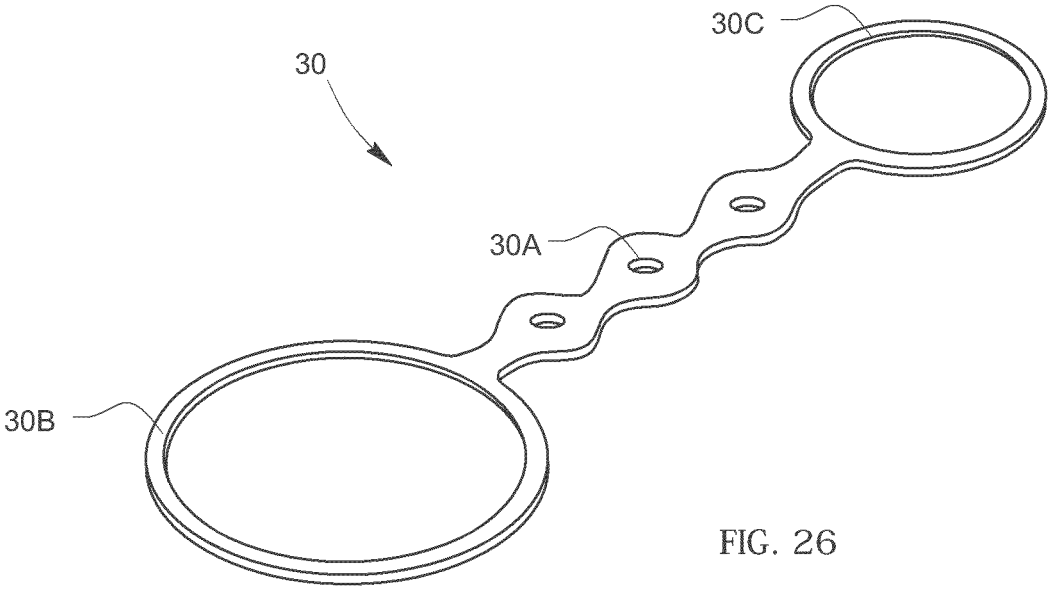
FIG. 26 is a perspective view of a preferred retaining ring.

FIG. 26 shows an optional tether 30 with one of preferably three or more optional accessory through-holes labeled 30A as well as overcap retention ring 30C and bottle retention ring 30B are also labeled. The overcap retention ring portion 30C preferably could be assembled in overcap retention ring groove 14D such that it spins freely but is captive and 30B could be assembled to the preferable bottle held under 40C. Optional tether 30 could have one or two accessory through-holes although three or more is in most cases more preferable such that multiple accessories can be placed in the holes.

Figure 27:
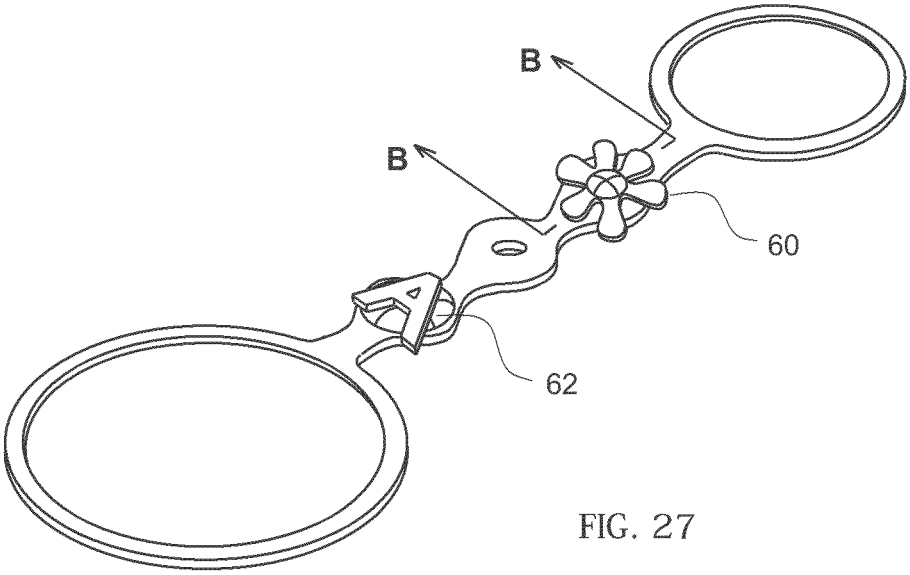
FIG. 27 is a perspective view of a preferred retaining ring.

FIG. 27 shows an optional tether 30 with two of the accessory through-holes filled with emblems 62 and 60. Emblems 62 and 60 are preferably injection molded. Emblem 62 shows a preferably molded or otherwise formed and preferably colored, painted or otherwise decorated letter "A" although many more different emblems could be used such as other letters, flowers (like emblem 60), bugs, badge, logos, etc. Section lines B-B are also shown.

Figure 28:
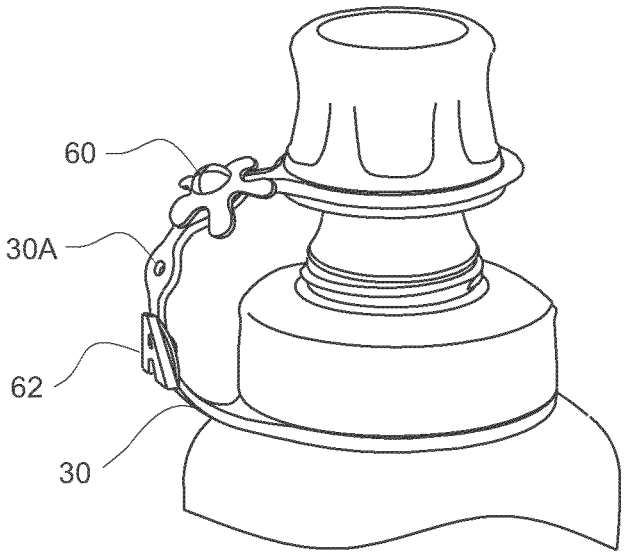
FIG. 28 is a perspective view of a preferred upper portion of a bottle.

FIG. 28 shows an optional tether 30 assembled with a cap assembly and bottle with two of the preferably three or more accessory through-holes filled with emblems 62 and 60. Only the top portion of bottle is shown for drawing simplicity.

Figure 29:
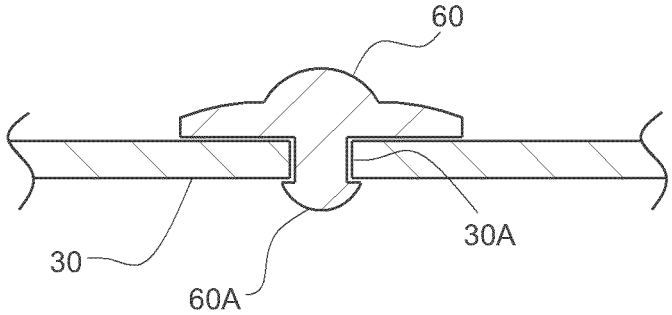
FIG. 29 is a sectional view of a portion of a retaining ring strap, taken along section lines B-B in FIG. 27.

FIG. 29 shows a section of optional tether 30 taken along lines B-B in FIG. 27 showing how nub 60A holds emblem 60 (or other emblems or the like) in place in through-hole 30A such that it can be press through 30A and be removably retained therein. Preferably emblems and/or tether 30 are injection molded or otherwise formed from a malleable plastic or the like such that nub 60A and/or through-hole 30A can deform and be pressed into place.

Figure 30:
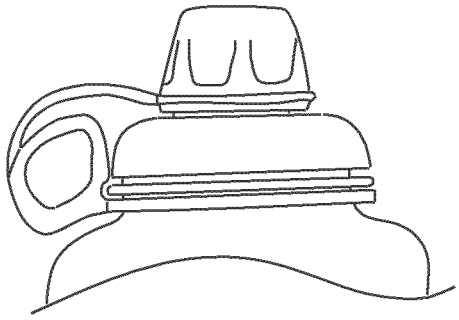
FIG. 30 is a perspective view of a preferred bottle with retaining ring.
Figure 31:
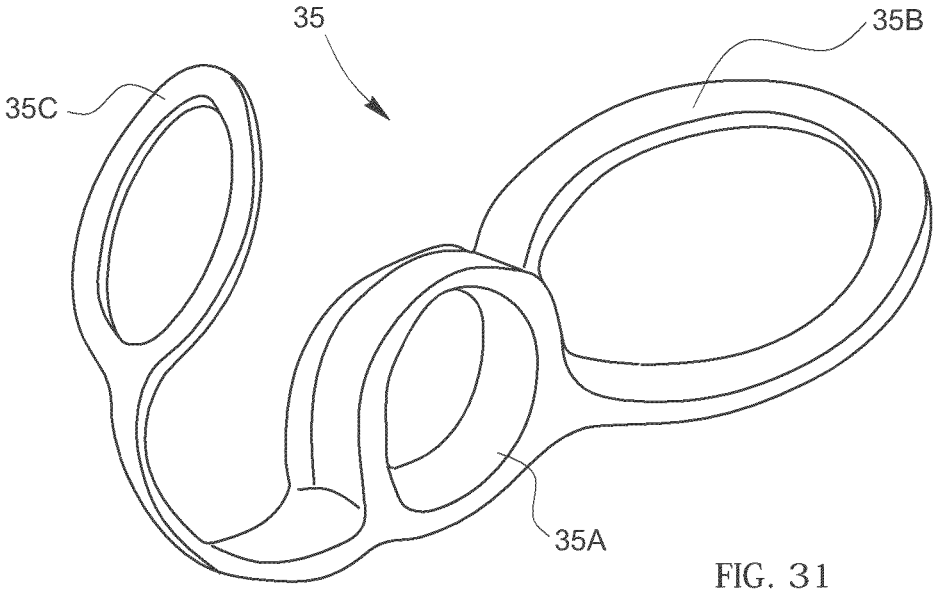
FIG. 31 is a perspective view of a preferred alternate retaining ring.

FIGS. 30 and 31 show another optional tether and combined ring 35 having a large loop 35B at one end to secure to a bottle neck, a smaller loop 35C to connect to the overcap, and a central finger ring 35C. The optional tether ring 35 is constructed such that it can rotate under tether retaining ring 40C (see FIG. 10) such that the finger loop can be turned and is not fixed to the cap body. One end of the tether preferably is constructed to attach to the overcap and the other preferably to the bottle.

FIG. 31 shows optional tether and combined ring 35 alone without cap assembly and bottle/container. Bottle ring portion 35B, finger/thumb ring 35A, and overcap ring portion 35C are labeled. Optional ring 35 would preferably be injection molded or the like from plastic or the like or some other preferably flexible material.

The embodiments shown in FIGS. 7-21, 24-25 are preferably axially symmetric about a vertical centerline (with the exception of some functional and aesthetic features like internal and external threads, grip details, thumb loop, tether ring connecting element, etc). FIG. 4 shows preferable external details, preferable internal threads can be seen in cross-section in FIG. 7 and others). Axis of symmetry line 8 is shown and labeled in FIG. 7 and is removed from other figures for the simplicity of the drawings. FIGS. 22-23 are also preferably axially symmetrical in the same way as described above with the exception of the functional pivot details, clasp/snap details, threads and various other distinct aesthetic/functional details (axis of symmetry line 8A is shown in FIG. 23). Although the disclosed designs are in general are preferably axially symmetrical (except for some aesthetic and functional elements as shown an described), they can be made with varying degrees of success generally not axially symmetrical (with some portions axially symmetrical and other portion not, or just generally not axially symmetrical or vaguely axially symmetrical), for example the preferable spout could less preferably be made such that it is off center in the cap body such that it is to one side, is angled, has an oval or other shaped opening, has interior rifling to manage flow or other distinct functional and/or aesthetic features that are not axially symmetric or is composted of portions that are axially symmetrical and portions that are not. Within the spirit of the invention some portions/areas could be made not axially symmetrical with varying degrees of success although in general many components and areas of the disclosed invention are preferably axially symmetrical with the exception of some function and aesthetic localized features as discussed and shown in the figures. The preferable bottle/container to be used with the preferred cap with integrated spout can take many forms as long as it engages with the preferable cap/spout. For example the bottle could be flattened in areas such that it is oval in cross section in those areas, triangular in cross-section and take many other shapes/forms as long as it still engages with the preferable cap and integrated spout.

Main Cap Body/Spout Retainer

The main cap/spout retainer 12, referred to as the main cap body, is preferably injection molded or otherwise molded, fabricated and/or formed from a suitable plastic or the like. The man cap body 12, as can be seen in FIG. 4 (and others), is preferably axially symmetric about axis line 8 (as shown in FIG. 7 and others) with the exception of the preferable finger grab loop 12A, external threads 12B for mating with the preferable overcap, and internal threads 12C for mating with container threads 40B. The cap body is preferably injection molded from Polypropylene plastic or the like but also could be made from Polyethylene (HDPE, LDPE, etc.) or some other similar plastic or the like. It could also be formed, molded, or the like from steel, stainless steel, titanium, or some other metal or the like. The cap body preferably has main internal screw threads 12C (one of the threads 12C in cross-section is labeled in FIG. 8) which are preferably used to connect it to a container/bottle or the like. The cap body also preferably has an integrated thumb, finger or other type loop 12A (as can be seen in FIG. 5 and others) which is preferably used to hold, carry, and/or attach the cap/bottle to an item or items. Also the cap body preferably has external screw threads 12B for mating with and holding the overcap 14 in place on the cap body such that access is provided to the preferable spout 18. The cap body further preferably has an area which is formed to accept and retain the preferable spout such that the spout is preferably held captive in the cap body. In some versions the spout may be insert molded, co-molded or otherwise integrally molded into the cap body. The cap body/container seal could also molded in the same way. Also the disclosed preferable screw threads 12C for mating with the preferable container, could be replaced with another types of mating connection similar to those found in other mating cap/containers found in the industry. The screw threads 12B mating the cap body to the overcap could be replaced with another type of mating connections similar to those found in other mating cap/containers found in the industry.

The main cap body/spout retainer preferably has an integrated loop 12A that can be used as a thumb/finger loop, though in some versions the cap body eliminates this loop feature altogether. In yet other versions the cap assembly can use the loop of the tether 20 and/or a loop feature can be molded separately with a ring and this ring can be held assembled under the ring retainer on the bottle and thus this thumb/finger ring could be carried assembled to the bottle (as best seen in FIG. 31). The overcap tether element of this ring could be eliminated such that the large ring would be assembled under the bottle tether retaining ring 40C, the ring for holding the overcap 35C would be removed as mentioned such that the remaining thumb/finger loop portion 35A can be used for a finger or the like and spins around as it is retained by the attached large ring 35B retained under 40C.

Spout

The disclosed invention preferably has a spout 18 formed for drinking and/or pouring from or the like. The preferable spout 18 as can be seen if FIG. 4 (and others) is preferably axially symmetric about axis line 8 (as shown in FIG. 7 and others). The spout 18 has an integrated seal/insert retention rib 18A (as labeled in FIG. 9). Ideally, the spout 18 is silicone molded from medical grade clear silicone rubber which is commonly used in manufacturing for a number of medical and consumer products. The preferable durometer or softness/hardness of the spout is between 50 to 80 shore, depending on the desired feel, as well as other mechanical characteristics desired. In most cases the preferable durometer for spout mouth feel, proper function of the overcap plug, manufacturability, as well as other mechanical properties is approximately 65 to 70 shore, although in some cases it may be desirable for the spout to be softer or harder, depending on the specific use, manufacturing issues, materials available and mechanical requirements desired.

The spout can be formed in a number of ways including using liquid silicone rubber molding, injection molding, compression molding, or many other methods used in manufacturing. Although it is disclosed that the preferable spout is preferably made from clear medical grade silicone or the like it can be made from a variety of other materials such as natural and synthetic rubber, thermoplastic elastomers (TPE), silicone molded in different grades, colors, clear with color tint, and a variety of other materials suited to specific desired spout characteristics.

The preferable spout 18 has smooth interior surfaces which enhances the characteristics of how well the spout pours minimizing the "glugging" of the liquid and creating a desirable laminar or smooth pour. It also should be noted that water flows particularly smoothly and tends bead on silicone which in most cases is desirable for enhancing flow characteristics. Textured or otherwise uneven surfaces also tend to affect how the liquid flows. Although it is not preferable, in some cases it may be desirable to texture, score, "rifle" (similar to gun barrel rifling with protrusions, grooves, or the like) or form flow ridges and or mold-in a pattern into the inside flow surface of the spout to strategically affect the characteristic of the pour, control/affect "glugging", as well as affect the characteristics of how the preferable plug stopper is held in place and how easily it releases from the spout. Potentially affecting the sealing characteristics of this interface.

Although not generally preferable the interior surfaces of the spout could be pocked like a golf ball such that the flow is affected by this uneven surface—in some cases this may be desirable. The molding tools used to make the preferable spout are preferably polished to produce a preferably smooth and transparent spout surface, which is not only conducive to a smooth pour and easier to clean but allows the user to clearly see the liquid held in the container (the container in many cases may be opaque).

The spout is preferably assembled to the cap body 12 by snapping/pressing it in from the underside of the cap body where it preferably seats in place and is retained captive but user-removable such that when a user wants to wash the cap the spout is not only easily removable for washing but replaceable if damaged for some reason.

Optionally the spout can be molded/formed/cut with an integrated bite valve similar to those commonly used in the industry but in most cases the resulting lower flow and reduced cleanability among other drawbacks make such a version less desirable. The bite valve can be configured close to the top of the spout such that the spout looks somewhat like a top-hat with a slit substantially bisecting the top of the crown (a somewhat centered single slit is commonly used as well as an "x" shaped slit is used in the industry as a bite actuated valve). Alternatively, the closure area of the bite-valve can be situated farther down into the spout and would look somewhat like the "top-hat" with the top flat surface of the crown cut off and the resulting top disc shape pressed down into the barrel of the "hat" and fixed, molded in place therein (the bite-valve area/portion would be preferably molded integrally with the spout).

For the less desirable bite valve option the overcap could be configured as just a simple cap without the insert plug area; or the insert plug could be configured to have a larger diameter than the mouth area of the spout; or the insert plug could be much shorter such that it provides a face seal and/or a plug seal with the top of the spout lip; or there are many other ways to provide a cap and secondary seal for this spout option. The spout preferably extends up and away from the cap body as shown and thus acts as a spout for drinking.

Spout Cap/Overcap. The disclosed invention preferably has a spout cap/overcap 14 which preferably covers (or otherwise seals) the spout when not in use. The overcap preferably comprises a spout plug for plugging (or sealing) the spout when the user desires this function. The preferable overcap 14 as can be seen if FIG. 4 (and others) is preferably axially symmetric about axis line 8 (as shown in FIG. 7 and others) with the exception of the preferable external finger grip details 14C and internal threads 14B (one in cross-section is labeled in the cross section in FIG. 9 and others) preferably for mating with the cap body treads 12B (labeled in cross-section in FIG. 8).

The overcap exterior cover portion is preferably injection molded from polypropylene or the like, but could also be molded with Polyethylene (HDPE, LDPE, etc.) or some other similar plastic or the like, and may alternatively be formed, molded, or the like from steel, stainless steel, titanium, or some other metal or the like.

The overcap preferably has a captive snapped-in, inserted plug part which is preferably molded from clear medical grade polypropylene or the like. Insert 16 is preferably axially symmetrical (with the exception of optional features like molded in logos and other less preferable aesthetic and/or functional detail(s) as discussed). Another material option for the preferable overcap is Polyethylene (HDPE, LDPE, etc.) or some other similar plastic or the like; alternatively it may be formed, molded, or the like from steel, stainless steel, titanium, or some other metal. The captive insert plug part 16 is preferably held captive, trapped but preferably allowed to spin in place as it is retained in the cover portion 14 of the overcap.

A benefit of the construction of insert 16 (which can be seen in FIG. 4 and other figures) is that it is designed to act along with preferable spout 18 (also shown in FIG. 4 and others) as pressure fail-safe, a kind of fail-safe valve or path for relieving pressure that could build up in the bottle. For example if pressure for some reason built up in the bottle beyond a certain designated pressure (the fit/geometry of the interface of spout 18 with insert 16 can be adjusted to regulate this fail-safe pressure) the interface between spout and insert can act as a pressure relief valve which releases pressure in the bottle out around the spout and through the preferable sliding/spinning gap between the overcap 14 and insert 16 (through the multi-seal ring areas S1, S2, S3 and out sliding interface gap G1 (as can be seen in FIG. 7).

The preferable cover ring portion of the overcap 14 has internal screw threads 14B or the like molded such that they mate with the preferable cap body 12 screw threads 12B (as seen in FIG. 9 and others). Although it is generally not preferable in some cases it may be desirable to insert-mold, co-mold or integrally mold (mold as one piece) the spout plug insert in the overcap ring portion (see FIG. 11 and others as an example).

Tether. The disclosed invention preferably has a tether 20 which may be injection molded from polyethylene or other materials in a desirable flexibility such that it functions as a tether to retain the overcap such that it is held captive and can preferably flex in use.

The tether is preferably assembled on one end to the overcap by snapping/pressing it in to a retention groove 14D and thus residing on the outside surface of the overcap. The fit of the tether to the overcap is preferably made such that the overcap twists freely while it while remaining preferably captive. The end of the tether opposite the overcap end is preferably affixed to retention feature 40C (preferably a ring residing on the preferable container). The tether 20 can be seen in FIG. 6, but also an optional embodiment can be seen in FIG. 26 wherein emblems can be attached such that the tether and thus bottle/container assembly can be customized.

Bottle. The disclosed invention preferably fits as a closure to a bottle. The cap with integrated spout can fit with a variety of bottle types, shapes sizes and kinds. Some examples of bottles are single and double wall metal and plastic bottles. The disclosed cap system works well with a double wall bottle for use with hot or cold liquids because the spout insulates the user from the liquid contained in the bottle and the user's lips are protected from being burned or from the coldness of a cold liquid. Some other bottle types that would work well with the disclosed cap system are Tritan or polycarbonate or the like, polypropylene, polyethylene, other plastics, metals, ceramics, and other materials.

Preferably the bottle/container has a mouth or neck with threads that engage with the cap/spout although as discussed other connection means could be employed.

Use. As disclosed above the preferable cap with integrated spout acts as a closure for a container/bottle or the like and is screwed or otherwise attached to the container as mentioned. The spout as disclosed preferably acts as a seal/gasket for sealing the cap assembly to the container as well as preferably acts with the insert/overcap assembly to seal the spout as disclosed above. The overcap with insert preferably acts as a seal and closure for the spout such that there is a screwed down (fully sealed, tightened-down and secured) position (see FIGS. 2, 7 and others) and a ready-use position (see FIG. 8 and others) wherein the user can unscrew the overcap/insert assembly and then leave it in the ready-use (still fully sealed and spill-safe) position wherein the overcap/insert cap be popped off with a thumb or pulled out like a cork in a bottle and thus removed for access to the drinking spout (see FIG. 3 and others for drinking/pouring position). The disclosed invention can be simply cleaned by easily disassembling the parts, pushing the spout back out and apart from the cap body and then washing, as well as the cap/spout assembly can be cleaned assembled together.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A cap for a bottle, comprising:

a main cap body formed from a first material and removably securable to the bottle, the main cap body having a spout removably attached to the main cap body and formed from a second material relatively more resilient than the first material and defining a passageway through the spout and the main cap body, wherein when the main cap body is secured to the bottle a fluid within the bottle can pass through the passageway defined by the spout, the passageway further being sufficiently large to allow the fluid to freely pour from the spout, the main cap body having threads for engaging a mating threaded surface on the bottle, the main cap body further forming a neck comprising neck threads; and an overcap removably attached to the main cap body, the overcap having an insert and overcap threads, the overcap being selectively attachable to the main cap body in a first position in which the insert is snugly received by the spout but in which the overcap threads are not engaged with the neck threads, and a second position in which the insert is received relatively farther within the spout and in which the overcap threads are engaged with the neck threads, the overcap and spout cooperating to form a substantially watertight seal when the overcap is in both the first position and the second position;

the spout further having an interior surface having an annular spout rib extending inwardly from the interior surface toward the passageway, the overcap further having an annular overcap rib positioned on and extending laterally outward from the insert, whereby the annular spout rib engages the insert and the annular overcap rib engages the interior surface to form the substantially watertight seal when the overcap is in the first position.

2. The cap of claim 1, wherein the insert is integrally formed with the overcap.

3. The cap of claim 1, wherein the insert is substantially cylindrical and extends downward along a central axis defined by the overcap, the overcap rib being perpendicular to the central axis.

4. A cap for a bottle, comprising:

a main cap body formed from a first material and being removably securable to the bottle, the main cap body having a first end forming a peripheral rim and a second end defining a spout, the spout being formed from a second material relatively more resilient than the first material, the spout defining an opening through the main cap body, wherein when the main cap body is secured to the bottle a fluid within the bottle can pass through the spout, the main cap body further having main cap body threads; and an overcap having an insert and overcap threads for mating engagement with the main cap body threads, the overcap being removably attachable to the main cap body in a first position in which the insert is snugly received by the spout, the overcap threads being disengaged from the main cap body threads in the first position, and a second position in which the main cap body threads are secured to the overcap body threads, the overcap and spout cooperating to form a substantially watertight seal when the overcap is in both the first position and the second position;

the spout further having an interior surface with an annular spout rib positioned adjacent the spout opening and extending inwardly from the interior surface toward the passageway, the overcap further having an annular overcap rib positioned on an external surface of the insert, whereby the annular spout rib engages the insert and the annular overcap rib engages the interior surface of the spout to form the substantially watertight seal when the overcap is in the first position.

5. The cap of claim 4, wherein the insert surrounds a portion of the spout when the overcap is attached to the main cap body.

6. The cap of claim 4, wherein the spout defines a spout rim, and further wherein the overcap snugly abuts the entirety of the spout rim when the overcap is attached to the main cap body.

7. The cap of claim 4, wherein the insert is received within the opening of the spout when the overcap is attached to the main cap body.

8. The cap of claim 7, wherein the insert further comprises a stem extending downward from the overcap, the annular overcap rib being formed on an exterior surface of the stem, further, wherein the stem is substantially cylindrical and extends downward along a central axis defined by the overcap, the annular overcap rib extending radially outward from the central axis, the annular spout rib being sized and configured to snugly receive the exterior surface of the stem.

9. The cap of claim 8, wherein the main cap body further comprises an interior main cap body surface having threads for engaging a mating threaded surface on the bottle, the main cap body further having a neck surrounding a base of the spout, the main cap body threads being formed on the neck.

10. The bottle closure of claim 9, wherein the insert is configured such that it freely spins in the overcap.

11. The cap of claim 9, wherein the spout is formed from a resilient material and the insert is formed from a substantially rigid material.

12. The cap of claim 4, wherein the overcap comprises an external upper surface and downwardly depending sidewalls that surround the spout when the overcap is attached to the main cap body, the external upper surface of the overcap further having a concavity.

13. The cap of claim 12, wherein the insert is formed separately from the overcap and affixed to the overcap, and further wherein the concavity is formed on the insert.

* * * * *